US006189301B1

(12) United States Patent
Nakagawa et al.

(10) Patent No.: US 6,189,301 B1
(45) Date of Patent: Feb. 20, 2001

(54) PACKAGING MACHINE

(75) Inventors: Yukio Nakagawa; Michihiro Kubo; Yukio Kakita, all of Shiga (JP)

(73) Assignee: Ishida Co., Ltd. (JP)

( * ) Notice: Under 35 U.S.C. 154(b), the term of this patent shall be extended for 0 days.

(21) Appl. No.: 09/283,165

(22) Filed: Apr. 1, 1999

(30) Foreign Application Priority Data

May 11, 1998 (JP) ..... 10-127116

(51) Int. Cl.[7] ..... B65B 9/20
(52) U.S. Cl. ..... 53/551; 53/248
(58) Field of Search ..... 53/551, 552, 248, 53/451

(56) References Cited

U.S. PATENT DOCUMENTS

| | | | | |
|---|---|---|---|---|
| 2,852,898 | * | 9/1958 | Berg | 53/552 |
| 2,915,866 | * | 12/1959 | Bartlo | 53/552 |
| 2,956,383 | * | 10/1960 | Gausman | 53/552 |
| 3,256,673 | * | 6/1966 | Tew | 53/551 |
| 3,262,244 | | 7/1966 | Cutler et al. . | |
| 3,498,022 | * | 3/1970 | Godet | 53/248 |
| 3,525,193 | * | 8/1970 | Cutler | 53/551 |
| 3,528,214 | * | 9/1970 | Calvano | 53/551 |
| 3,611,657 | * | 10/1971 | Inoue | 53/551 |
| 4,563,862 | | 1/1986 | McElvy . | |
| 4,566,253 | | 1/1986 | Jones . | |
| 4,589,247 | * | 5/1986 | Tsuruta | 53/551 |
| 4,630,429 | * | 12/1986 | Christine | 53/551 |
| 4,656,818 | * | 4/1987 | Shimoyama | 53/551 |
| 5,170,609 | * | 12/1992 | Bullock | 53/551 |
| 5,412,927 | * | 5/1995 | Miyazaki | 53/552 |

FOREIGN PATENT DOCUMENTS 0107474 5/1985 (EP) .

* cited by examiner

*Primary Examiner*—John Sipos
(74) *Attorney, Agent, or Firm*—Coudert Brothers

(57) ABSTRACT

A form-fill-seal packaging machine has a halting device above its transverse sealer below a cylindrical chute through which articles to be packaged are dropped cyclically in batches. A film is bent into a tubular form and pulled down around the chute to the transverse sealer. The halting device serves to squeeze the film such that the free-falling articles are temporarily halted before reaching the transverse sealer such that the articles can pass through the transverse sealer in a more compactly bunched batches. This makes it less likely for any of the articles to be caught between sealing devices of the transverse sealer and the work efficiency of the packaging machine can be improved.

16 Claims, 5 Drawing Sheets

PACKAGING MACHINE

BACKGROUND OF THE INVENTION

This invention relates to a form-fill-seal type packaging machine for continuously producing packaged products by filling bags with articles such as candies while these bags are being formed.

As disclosed for example in Japanese Patent Publication Tokkai 10-7102, a packaging machine of this type is typically adapted to bend an elongated bag-making material (the "film") by wrapping it around a tubular chute, to make it into a tubular form by sealing its side edges together longitudinally, to thereafter seal it and cut it transversely at specified intervals to continuously form bags, and to drop articles to be packaged into the bags through the chute while these bags are being formed. The transverse sealing of the tubularly formed film is usually carried out by clamping it by a device for thermal sealing, and the film is separated at the sealed positions to be made into individual packaged bags. Thus, the sealing must be effected during time intervals between periods during which articles are dropped through the chute.

The current tendency in the packaging technology is to shorten the intervals at which the articles to be packaged are dropped in successive batches so as to improve the productivity. Although the intervals are shortened, there will be enough space of time left between the dropping of one batch to that of the next if articles in each batch drop closely together and the sealing device can be operated to clamp the film during such a space of time. In reality, however, articles which are dropped together as a batch become dispersed while undergoing a free fall inside the chute. As a result, it is likely that some of the articles are caught when the sealing device clamps the film transversely.

SUMMARY OF THE INVENTION

It is therefore an object of this invention to provide an improved packaging machine of the form-fill-seal type capable of transversely sealing the film without catching the articles being dropped in although the intervals at which they are dropped in batches are shortened.

A packaging machine embodying this invention, with which the above and other objects can be accomplished, may be characterized as having what is herein referred to as a "halting device" above a transverse sealer and a cylindrical chute around which a film is formed into a tubular form and through which articles to be packaged are dropped cyclically in batches. The function of the halting device is to momentarily halt the free-falling motion of the articles before reaching the transverse sealer such that the articles dropped together within the same cycle will pass through the transverse sealer as a more compactly bunched batch. The more compact the batches which pass through the transverse sealer, the easier it becomes to avoid catching any of the articles between sealing devices of the transverse sealer which clamp the film to effect the transverse sealing.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
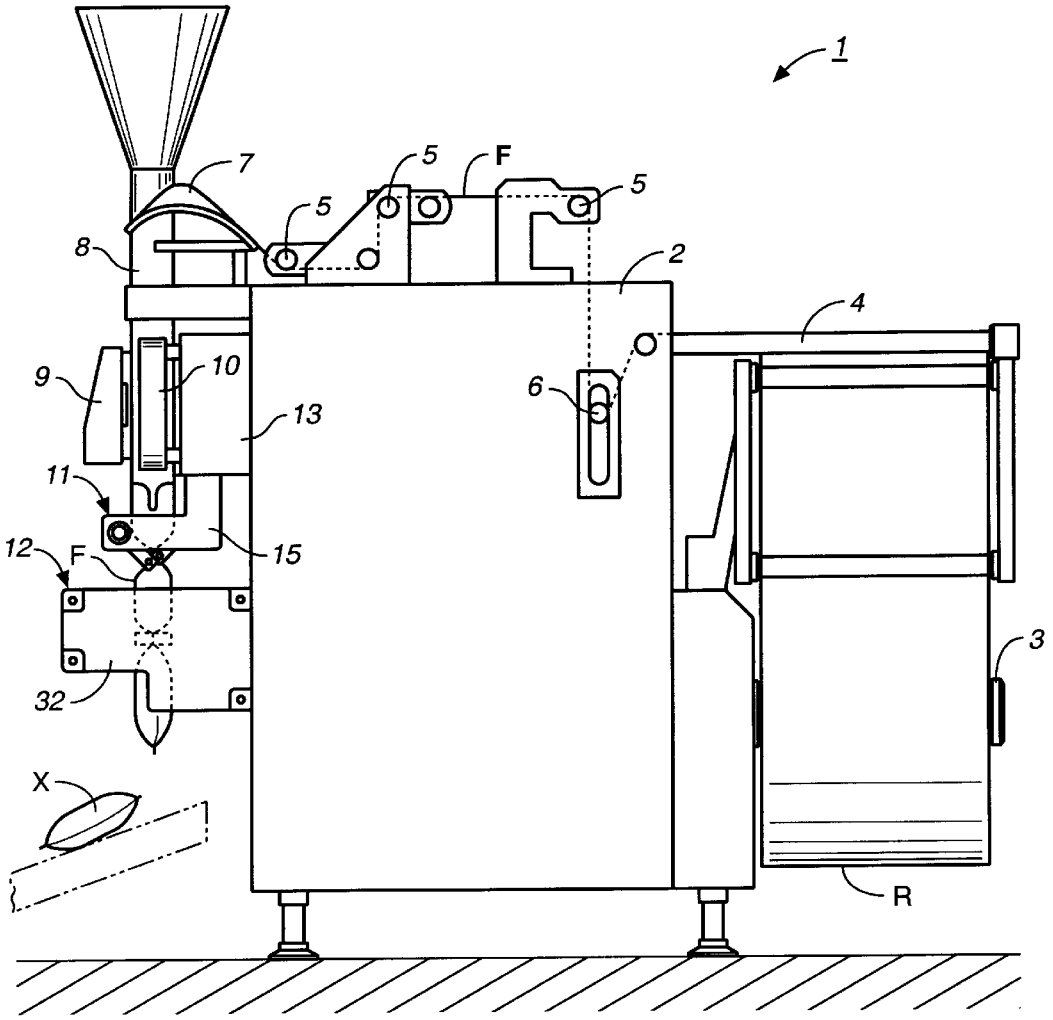
FIG. 1 is a schematic side view of a packaging machine embodying this invention.

FIG. 1 shows a packaging machine 1 embodying this invention. A roll R of elongated bag-making material (the "film" F) is set on a rotary shaft 3 at the back of a main body 2, and the film F is pulled out of this roll R as the shaft 3 turns around. The direction of motion of the film F is changed by 90° by means of a diagonally disposed guide bar 4, and the film F is guided to a former 7 at a front part of the main body 2 by means of a plurality of guide rollers 5 and a dancer roller 6. The former 7 is disposed as if to hug a vertically extending tubular chute 8 so as to bend the film 7 guided thereto into a tubular form. Batches of articles having a desired total weight, discharged, say, from a combinational weigher to be packaged together, are dropped from the top of the chute 8. A longitudinal sealer 9 is disposed in front of the chute 8 and a pair of pull-down belts 10 is disposed on both sides of the chute 8 such that the film F is transported downward by the pull-down belts 10 while its mutually overlapping side edges are longitudinally sealed together by the longitudinal sealer 9.

Disposed below the chute 8 is a squeezing device 11, as an example of the "halting device" of this invention, for squeezing the tubularly formed film F from the front and the back so as to temporarily halt the fall of the articles dropped into the chute 8. Disposed still below this squeezing device 11 is a transverse sealer 12 for transversely sealing the tubular film F by clamping it from the front and the back in the direction of its breadth. The squeezing by the squeezing device 11 is released after the film F is transversely sealed by this transverse sealer 12 such that the batch of articles is dropped into the bag, of which the bottom has just been formed by the transverse sealing. After the article batch has been dropped into the bag, the transverse sealer 12 seals the film F again transversely above the article batch which has dropped into the bag. The film F is cut transversely across the area over which the transverse sealing has been effected, and a packaged product X with the article batch sealed inside the bag is discharged.

Figure 2:
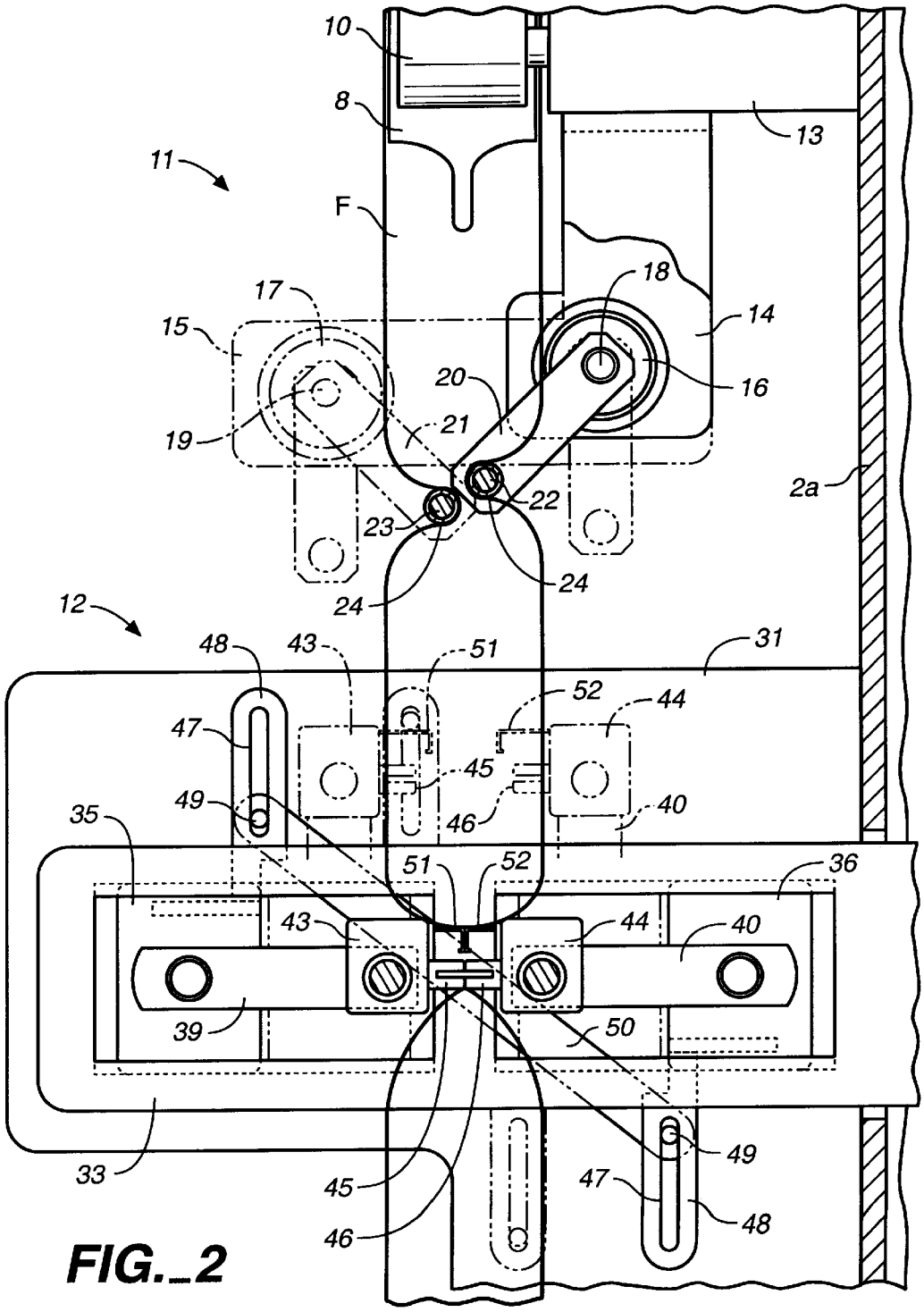
FIG. 2 is a sectional horizontal view of a portion of the packaging machine of FIG. 1 for showing the structures of its squeezing device serving as an example of the "halting device" of this invention, as well as its transverse sealer.
Figure 3:
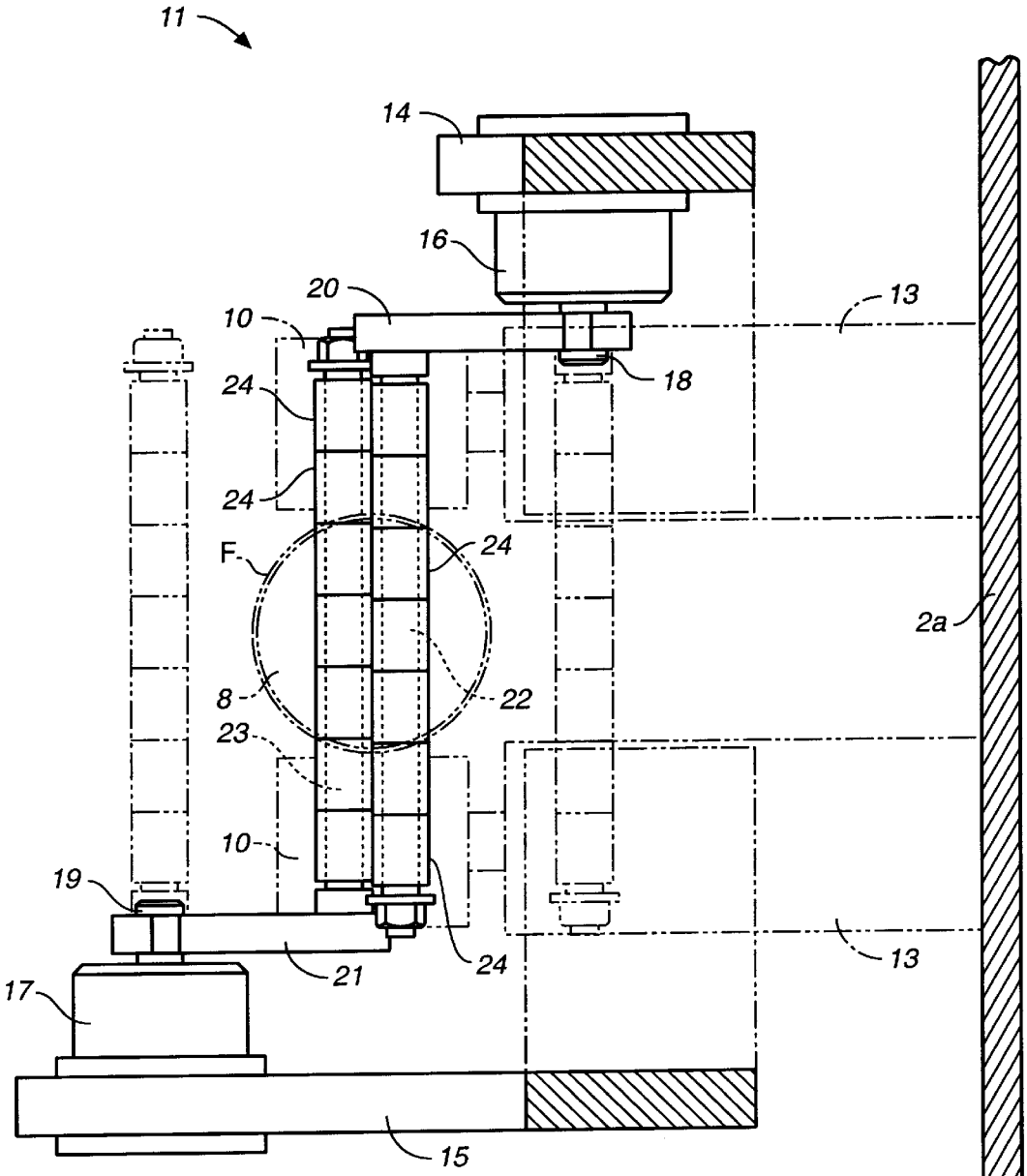
FIG. 3 is a sectional plan view of a portion of the packaging machine of FIG. 1 for showing the structure of its squeezing device.

As shown in FIGS. 2 and 3, the squeezing device 11 comprises a pair of support members 14 and 15 extending forward from the bottom surfaces of support frames 13 for the pull-down belts 10 and each supporting a rotary cylinder 16 or 17 near its tip. It should be noted that the cylinder 17 is positioned farther forward and somewhat lower than the other cylinder 16. Levers 20 and 21 are attached respectively to the rotary shafts 18 and 19 of the cylinders 16 and 17, and squeezing bars 22 and 23 are each attached to the other end (distal from the shafts 18 and 19 of the cylinders 16 and 17) of the corresponding one of the levers 20 and 21 so as to extend parallel to each other below the chute 8, one (i.e., the bar 23) in front of the tubular film F and the other (i.e., the bar 22) behind the film F. As can be seen more clearly in FIG. 3, each of the squeezing bars 22 and 23 has a plurality of contact rings 24 engaging loosely and rotatably mounted therearound. Under the normal condition wherein the cylinders 16 and 17 are not switched on, the squeezing bars 22 and 23 both hang vertically downward, being separated from each other, as shown by chain lines in FIGS. 2 and 3. When the cylinders 16 and 17 are switched on, the squeezing bar 23 on the front side of the film F begins to move backward and the squeezing bar 22 on the back side of the film F begins to move forward toward each other such that the film F is squeezed therebetween, as shown by solid lines in FIGS. 2 and 3, and the fall of the articles inside the tubular film F is thereby interrupted.

When the cylinders 16 and 17 are operated to squeeze the film F between the squeezing bars 22 and 23, as described above, the backward motion of the squeezing bar 23 on the front side is started somewhat before the start of the forward motion of the squeezing bar 22 on the back side. As the two squeezing bars 22 and 23 squeeze the film F, as can be seen more clearly in FIG. 2, the squeezing bars 22 and 23 are both moving somewhat upward due to the rotary motions of the levers 20 and 21 and the forward squeezing bar 23 is at a somewhat lower position than the backward squeezing bar 22 but the film F is actually not clamped therebetween, being merely squeezed with a small gap left between the two squeezing bars 22 and 23. The tubular film F is pushed from behind first and then from the front and is thereby bent into a serpentine S-shape. Thus, the articles inside the tubular film F do not suffer any excessive pressure and hence are not crushed, while their downward motion is effectively halted. Since the two squeezing bars 22 and 23 are operated so as not to collide with each other as they are rotated, they are not likely to be damaged. Since the squeezing bars 22 and 23 contact the film F through the loosely and rotatably mounted contact rings 24, furthermore, the tubular film F is not likely to be damaged by the friction with the bars 22 and 23.

Figure 4:
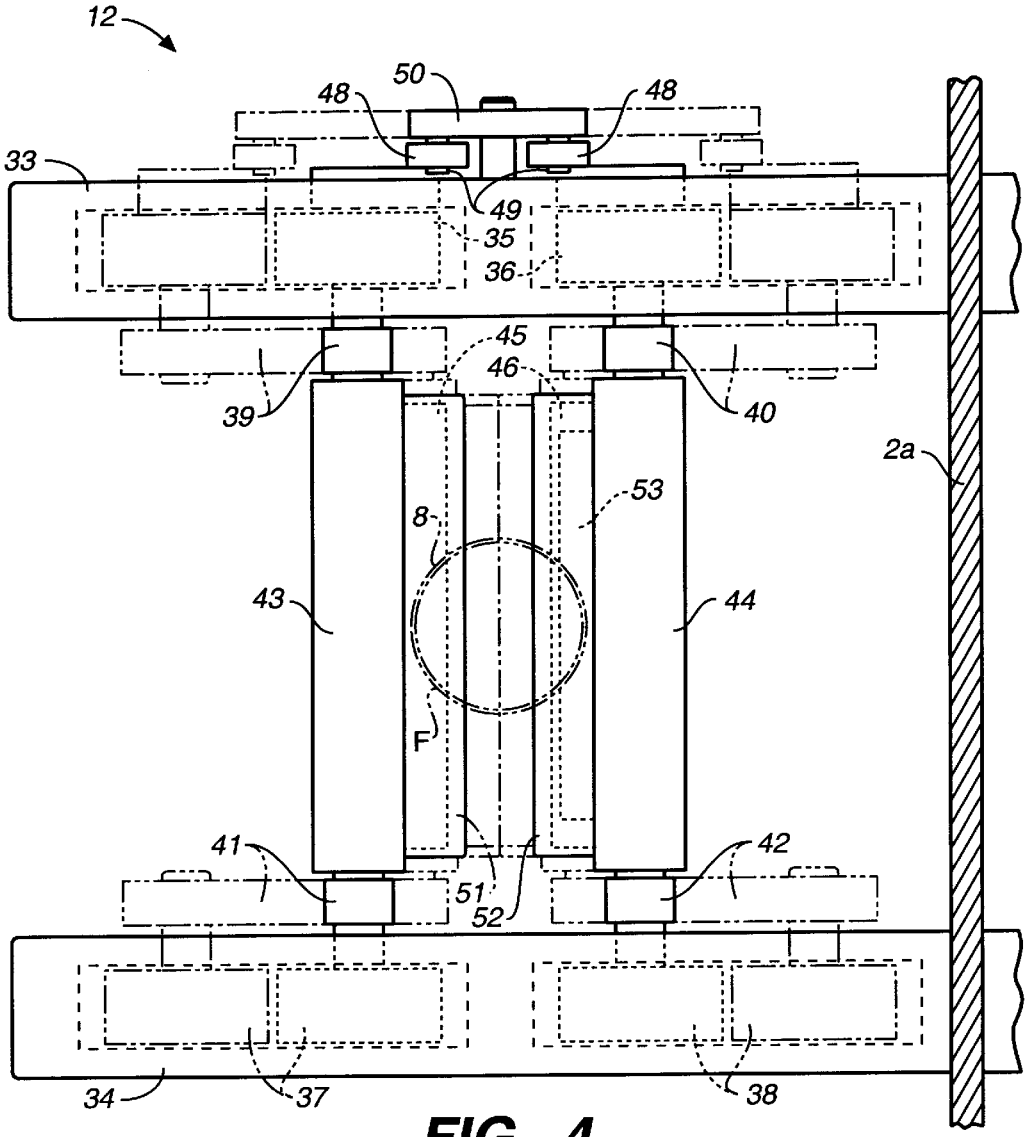
FIG. 4 is a sectional plan view of another portion of the packaging machine of FIG. 1 for showing the structure of its transverse sealer.

The transverse sealer 12 is disposed, as shown in FIGS. 2 and 4, between a pair of protective plates 31 and 32 in front of the main body 2, having a pair of side frames 33 and 34 extending forward from a front wall 2*a* of the main body 2. Slidable plates 35, 36, 37 and 38 are provided at forward and backward positions inside these frames. Elongated members (the "arms") 39, 40, 41 and 42 are respectively attached rotatably to the slidable plates 35–38. Support blocks 43 and 44 are carried respectively between the two forward arms 39 and 41 and between the backward arms 40 and 42, and sealing devices 45 and 46, which together form a pair, are respectively supported by these support blocks 43 and 44. Each of the slidable plates 35 and 36 in the left-hand side frame 33 is provided with a bracket 48 with an elongated opening 47, and a lever 50 is rotatably supported by the same side frame 33. Protruding from this lever 50 are two pins 49 each engaging inside a corresponding one of these elongated openings 47 of the brackets 48.

Shutters 51 and 52 are respectively provided on the support blocks 43 and 44, biased by springs (not shown) so as to protrude toward each other, serving to clamp the tubularly formed film F transversely immediately above the sealing area before the sealing devices 45 and 46 contact each other. A cutter 53 is contained in the support block 44 or the sealing device 46 on the back side, serving to cut the film F transversely at about the middle of the sealing area when the film F is clamped between the sealing devices 45 and 46.

Figure 5:
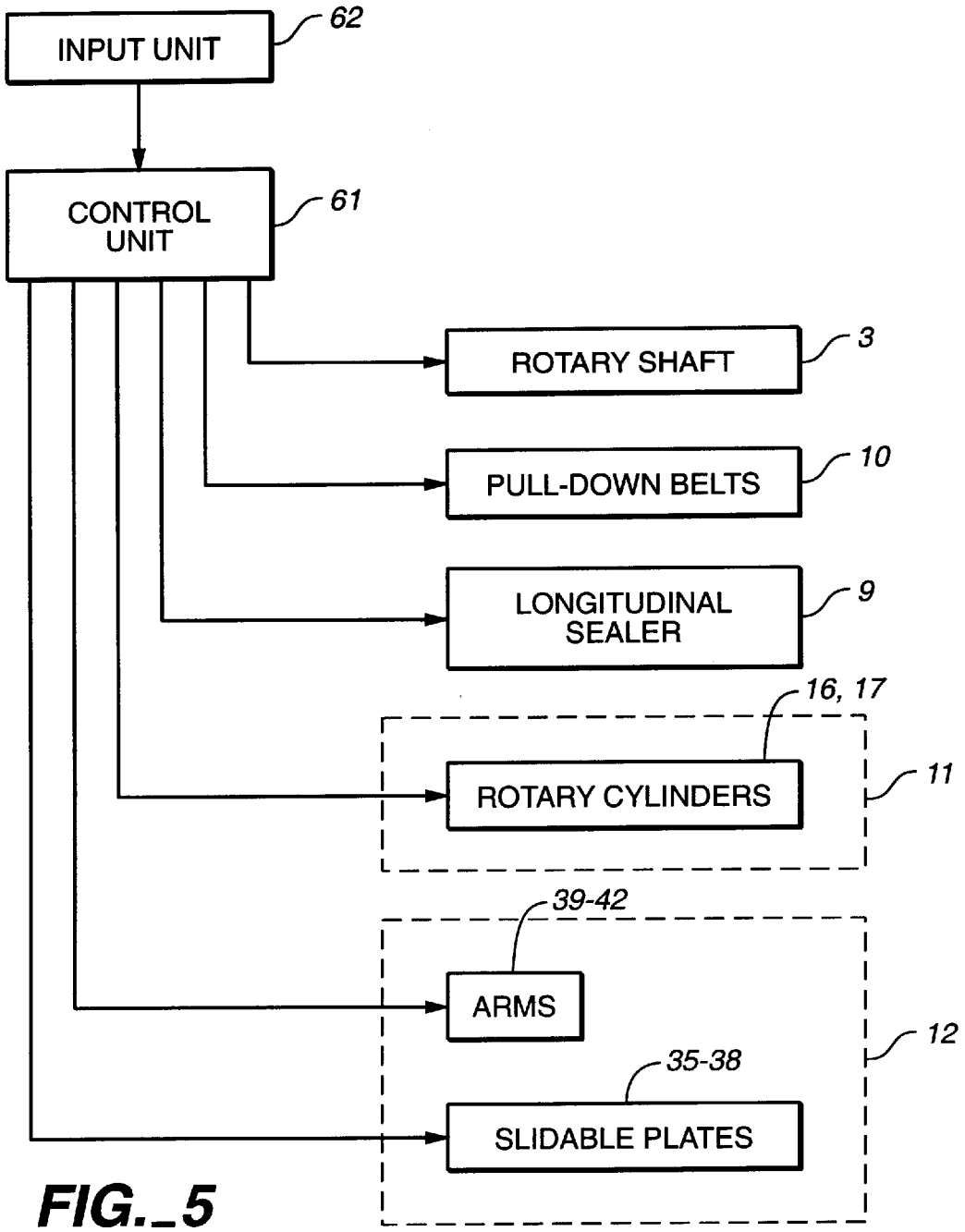
FIG. 5 is a control diagram of packaging machine of FIG. 1.

Although not shown in FIGS. 1–4, a control unit (indicated by numeral 61 in FIG. 5) is provided for controlling the operations of the rotary shaft 3 of the roll R to unwind the film F, the pull-down belts 10, the longitudinal sealer 9, the rotary cylinders 16 and 17 of the squeezing device 11, and the arms 39–42 and the slidable plates 35–38 of the transverse sealer 12. The control unit 61 is adapted to receive command signals from an input unit 62 and to control the rotary shaft 3 and the pull-down belts 10 accordingly such that the tubularly formed film F will be transported downward in a continuous motion along the chute 8 and finished packaged products X will be discharged at specified time intervals. The longitudinal sealer 9 is kept in the ON-condition such that the tubularly formed film F which is continuously fed will remain compressed towards the chute 8 for its longitudinal sealing. Batches of articles to be packaged, say, from a combinational weigher, may be dropped through the chute at a fast rate of about 120–150 cycles per minute at constant intervals.

The arms 39–42 of the transverse sealer 12 are rotated such that the pair of support blocks 43 and 44 and also the sealing devices 45 and 46 will move in a mirror-symmetric manner. As the arms 39–42 are thus rotated, the slidable plates 35–38 are caused by the lever 50 to undergo a reciprocating motion in the forward-backward direction also in a mirror-symmetric manner between the forward plates 35 and 37 and the backward plates 36 and 38 such that the mutually opposite contact surfaces of the sealing devices 45 and 46 will move linearly downward at the same speed as the tubular film F which is being pulled down from when the two sealing devices 45 and 46 come to contact each other until when they are separated and move away from each other. Each of the sealing devices 45 and 46 is controlled to move on a generally D-shaped trajectory, returning by following a circular trajectory back to the beginning point of the straight trajectory. While the sealing devices 45 and 46 move on the linear portions of their D-shaped trajectories, the tubular film F remains clamped and is transversely sealed. The cutter 53 protrudes in the meantime to sever the film F at about the middle of the transversely sealed area.

Prior to the contacting of the sealing devices 45 and 46 in each of the cycles of operations of the transverse sealer 12, the shutters 51 and 52 come to contact each other, causing to close the tubular film F immediately above the sealing devices 45 and 46. As a result, the articles dropping inside are prevented from falling further and being caught between the sealing devices 45 and 46 when they contact each other.

The rotary cylinders 16 and 17 of the squeezing device 11 are switched on and off intermittently at constant short intervals such that the squeezing bars 22 and 23 will approach each other to bend the tubular film F as shown in FIG. 2 during the short period of time between the articles passing through the chute 8 in successive batches. As a result, the articles which are falling inside the chute 8 are halted momentarily. Although articles to be packaged are dropped in batches, some of them may end up traveling between two successive batches. The squeezing device 11, being operated as above, serves to clear the space between two successively dropped batches, thereby further reducing the probability that articles may be caught between the sealing devices 45 and 46. Explained more in detail, articles falling between two successively dropped batches are halted momentarily as the squeezing bars 22 and 23 approach each other and are allowed to fall further downward to the transverse sealer 12 together with the batch which is falling after them. In other words, articles are more closely bunched together as they pass through the transverse sealer 12 such that the occurrence of defective transverse sealing due to articles being caught between the sealing devices 45 and 46 can be more dependably avoided. Since the squeezing bars 22 and 23 are adapted to move upward as they close, according to a preferred embodiment, the tubular film F tends to swell above the position at which it is squeezed. This tends to make it easier to catch the falling articles effectively and to supply the articles to the transverse sealer 12 below as a more compactly formed batch.

Although the invention was described above with reference to only one example, this example is not intended to be illustrative, and not as limiting. Many modifications and variations are possible within the scope of this invention. The halting device of this invention need not take the form of a squeezing device with rotary cylinders. Instead, use may be made of a device having a pair of horizontally slidable shutter plates and means for sliding them towards and away from each other cyclically. In summary, the present invention makes it possible to bunch up the articles dropped into the cylindrical chute into more compact batches such that defective transverse sealing can be avoided even if the form-fill-seal packaging machine is operated at a fast frequency.

What is claimed is:

1. A packaging machine comprising:

a cylindrical chute for allowing articles to undergo a fall therethrough;

film transporting means for transporting an elongated film longitudinally;

former for bending the film into a tubular form around said cylindrical chute;

a longitudinal sealer for sealing side edges of the film longitudinally;

a transverse sealer disposed below said cylindrical chute for transversely sealing the tubularly formed film to form a bag; and a halting device disposed between said cylindrical chute and said transverse sealer for temporarily halting the fall of articles through said cylindrical chute, said halting device including a pair of bars which sandwich the tubularly formed film therebetween and means for moving said bars toward each other to squeezing positions, thereby squeezing the tubularly formed film between said bars without clamping said film but by leaving a gap therebetween and halting the fall of the articles through said cylindrical chute.

2. The packaging machine of claim 1 wherein said squeezing positions are at different heights.

3. The packaging machine of claim 1 wherein said bars are both moving upward when reaching said squeezing positions to squeeze the film therebetween.

4. The packaging machine of claim 2 wherein said bars are moved upward when reaching said squeezing positions to squeeze the film therebetween.

5. The packaging machine of claim 1 wherein each of said bars has a plurality of rotatably mounted tubular contact rings, said bars contacting the film through said contact rings.

6. The packaging machine of claim 2 wherein each of said bars has a plurality of rotatably mounted tubular contact rings, said bars contacting the film through said contact rings.

7. The packaging machine of claim 3 wherein each of said bars has a plurality of rotatably mounted tubular contact rings, said bars contacting the film through said contact rings.

8. The packaging machine of claim 4 wherein each of said bars has a plurality of rotatably mounted tubular contact rings, said bars contacting the film through said contact rings.

9. The packaging machine of claim 1 further comprising shutters disposed between said halting device and said transverse sealer for clamping the tubularly formed film therebetween to thereby prevent the articles from falling inside the film.

10. The packaging machine of claim 2 further comprising shutters disposed between said halting device and said transverse sealer for clamping the tubularly formed film therebetween to thereby prevent the articles from falling inside the film.

11. The packaging machine of claim 3 further comprising shutters disposed between said halting device and said transverse sealer for clamping the tubularly formed film therebetween to thereby prevent the articles from falling inside the film.

12. The packaging machine of claim 4 further comprising shutters disposed between said halting device and said transverse sealer for clamping the tubularly formed film therebetween to thereby prevent the articles from falling inside the film.

13. The packaging machine of claim 5 further comprising shutters disposed between said halting device and said transverse sealer for clamping the tubularly formed film therebetween to thereby prevent the articles from falling inside the film.

14. The packaging machine of claim 6 further comprising shutters disposed between said halting device and said transverse sealer for clamping the tubularly formed film therebetween to thereby prevent the articles from falling inside the film.

15. The packaging machine of claim 7 further comprising shutters disposed between said halting device and said transverse sealer for clamping the tubularly formed film therebetween to thereby prevent the articles from falling inside the film.

16. The packaging machine of claim 8 further comprising shutters disposed between said halting device and said transverse sealer for clamping the tubularly formed film therebetween to thereby prevent the articles from falling inside the film.

* * * * *